US006457202B1

(12) United States Patent
Torres et al.

(10) Patent No.: US 6,457,202 B1
(45) Date of Patent: Oct. 1, 2002

(54) SWEEPING MACHINE BRUSH MOUNTING ASSEMBLY

(76) Inventors: Randolph Torres, 9747 Pebble Beach Dr., Santee, CA (US) 92071; Doug Shelstrom, 9747 Pebble Beach Dr., Santee, CA (US) 92071

( * ) Notice: Subject to any disclaimer, the term of this patent is extended or adjusted under 35 U.S.C. 154(b) by 91 days.

(21) Appl. No.: 09/694,576

(22) Filed: Oct. 23, 2000

Related U.S. Application Data

(63) Continuation-in-part of application No. 09/076,076, filed on May 11, 1998, now Pat. No. 6,134,740.

(51) Int. Cl.[7] ..... A46B 13/02
(52) U.S. Cl. ..... 15/180; 15/87; 15/198
(58) Field of Search ..... 15/87, 180, 195, 15/198

(56) References Cited

U.S. PATENT DOCUMENTS

| | | | | | |
|---|---|---|---|---|---|
| 1,434,109 | A | * | 10/1922 | Finnell | 15/180 X |
| 1,564,226 | A | * | 12/1925 | Finnell | 15/180 |
| 2,242,577 | A | * | 5/1941 | Finnell | 15/180 |
| 2,853,729 | A | * | 9/1958 | Link | 15/180 |
| 2,917,767 | A | * | 12/1959 | Lechene | 15/180 |
| 2,923,958 | A | * | 2/1960 | Lechene | 15/198 |
| 3,526,919 | A | * | 9/1970 | Byers | 15/180 |
| 3,678,530 | A | * | 7/1972 | Horton et al. | 15/180 |
| 3,758,908 | A | * | 9/1973 | Maltarp | 15/180 |
| 3,766,589 | A | * | 10/1973 | Arenas | 15/180 |
| 3,875,607 | A | * | 4/1975 | Rosseau | 15/180 |
| 3,943,594 | A | * | 3/1976 | Alvin | 15/180 |
| 4,615,064 | A | * | 10/1986 | Alvin | 15/180 |
| 4,765,013 | A | * | 8/1988 | Lowe | 15/180 |
| 5,737,793 | A | * | 4/1998 | Prohoroff | 15/180 |
| 6,026,533 | A | * | 2/2000 | Prohoroff | 15/180 |

FOREIGN PATENT DOCUMENTS

| | | | | |
|---|---|---|---|---|
| DE | 132467 | * | 10/1978 | 15/180 |
| DE | 151553 | * | 10/1981 | 15/180 |
| EP | 284483 | * | 9/1988 | 15/180 |

* cited by examiner

*Primary Examiner*—Mark Spisich
(74) *Attorney, Agent, or Firm*—Donn K. Harms

(57) ABSTRACT

An improved brush assembly for mounting on horizontally rotating brushes on street sweeping machines. A circular disk carries brush holders holding bristles in the desired configuration. The brush holders are clamped to the disk by a clamp having a clamp bar that engages the brush holder and is maintained parallel to the brush holder with an offset support. A bolt and nut combination between the brush holder and disk presses the clamp bar firmly against the brush holder to hold it in place. Alignment holes in the brush holder cooperate with pins on the clamp bar to maintain the brush holder in the proper position. Holes through the brush holder have transverse walls so that U-shaped bristles can be extended through the holes with legs of the U-shape on opposite sides of the transverse walls. The brush holder can be configured with a reinforced strip area for extra strength and a pair of reinforced tabs to provide further strength to resist cracking and fatigue failure during use.

5 Claims, 6 Drawing Sheets

SWEEPING MACHINE BRUSH MOUNTING ASSEMBLY

This application is a continuation-in-part of U.S. application Ser. No. 09/076,076, filed May 11, 1998 U.S. Pat. No. 6,134,740.

FIELD OF THE INVENTION

This invention relates to machines, such as street sweepers, that move across a surface while sweeping that surface with rotary brushes mounted on disks generally parallel to the ground.

BACKGROUND OF THE INVENTION

Sweeping machines for streets, factory floors and the like generally include wheel mounted vehicle that moves across a street, floor or other surface to be swept. Most include a brush assembly on each side of the machine, each assembly including a disk on which the brush is mounted with the disk approximately parallel to the surface to be swept and rotatable to sweep dirt and debris from the surface towards a container for disposal.

Conventionally, each brush assembly consists of a heavy metal disk mounted on the sweeping machine for rotation adjacent to the surface to be swept. Brush holders, each a segment of a circle, are bolted to the underside of the disk adjacent to the disk periphery forming a circle. Generally, the brushes are made up of U-shaped bristles formed from stiff metal wire, such as piano wire and are attached to the brush holder.

These bristles tend to wear rapidly, particularly where the surface is rough, such rough concrete surfaces. Therefore, the brush holders must be removed from the disk and the bristles be replaced at regular intervals. To replace the brush holders requires elevation of the support disks and unbolting the brush holders from the support disks. This is a time consuming task which is difficult and can be dangerous because of the great weight of the support disks. The bolts may become jammed, rusted and are supporting the weight of the brush holders and brushes. Reinstallation requires holding the brush holders so that holes in the holders align with corresponding holes in the support disks. This is difficult with the heavy brush holders adjacent to the ground with no means of maintaining alignment during installation.

The brush holders, which are generally formed from a plastic material also wear and suffer cracks and must be replaced quite often. In addition the angle of the bristles to the surface being swept is often other than the optimum sweeping angle.

Thus, there is a continuing need for improved brush assemblies that allow replacement of brush holders and bristles in an easy, rapid and safe manner, that maintain alignment between brush holders and support disks during disassembly and reassembly that provide an optimum sweeping angle between bristles and the surface to be swept and that are resistant to cracking of brush holders in use.

SUMMARY OF THE INVENTION

The above-noted problems, and others, are overcome in accordance with this invention by a brush assembly which comprises a circular disk for mounting on a sweeping machine adjacent to a surface to be swept, brush holders for mounting along the periphery of the lower side of the disk and alignment holes in the brush holders for properly aligning the brush holders and a clamping arrangement for clamping the brush holders against the disk.

The brush holders have a number of bristle mounting holes extending from the side in contact with the disk to the opposite side for receiving brush-bristles. The bristles have a narrow U-shape. A transverse retainer wall extends across each mounting hole to hold the bristles, which are installed in the holes with the two legs of the U-shape on opposite sides of the retainer wall.

The clamping arrangement comprises a clamp bar that extends along the surface of each brush holder opposite the side in contact with the circular disk and extends beyond the brush holder towards the center of the disk. The clamp bar is firmly pressed against the disk by at least one threaded member extending through the clamp bar and disk, typically a bolt and nut arrangement or by a stud secured to the plate and extending through the clamp bar to a nut. For best results an offset support is secured to the edge of the bar towards the disk center, with the threaded member between the offset support and the brush holder. The offset support preferably has a thickness approximately equal to the thickness of the brush holder to assure uniform clamping pressure on the brush holder.

In order to assure proper alignment of the brush holder with the circular disk, alignment pins are provided on the clamp par to project into corresponding alignment holes in the brush holder.

For best results, the bristle mounting holes should be angled outwardly of the disk center an angle to the disk of about 60° to 65°, to provide optimum sweeping of debris and dirt. Optimally, this angle has been found to be about 62°. While any suitable number of bristle mounting holes and hole dimensions may be used, three rows of holes along the disk periphery provides excellent results. Best results are obtained with bristle mounting hole cross sections having widths of from about 0.4 to 0.6 inch and depth of from 0.7 to 1 inch. The overall thickness of the brush holder is preferably from about 0.75 to 1.25 inch, so that length of the bristle mounting holes is correspondingly just greater that 0.75 to 1.25 inch.

In order to prevent cracking of the brush holders at corners of the bristle mounting holes or at any other intersections between flat surfaces, all such corners are preferably rounded. Ideally, the radius of all corners is from about 0.030 to 0.150 inch. We have found that this rounding apparently prevents stress peaks at those corners and will add considerably to the useful life of the brush holders.

While the brush holders may be formed from any suitable material such as aluminum or high strength plastics, for optimum durability together with convenience of manufacture by injection molding, nylon of the sort available from Dupont under the "Nylon 66" designation is preferred. For further strength, the nylon may be filled with fibers such as short glass fibers.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
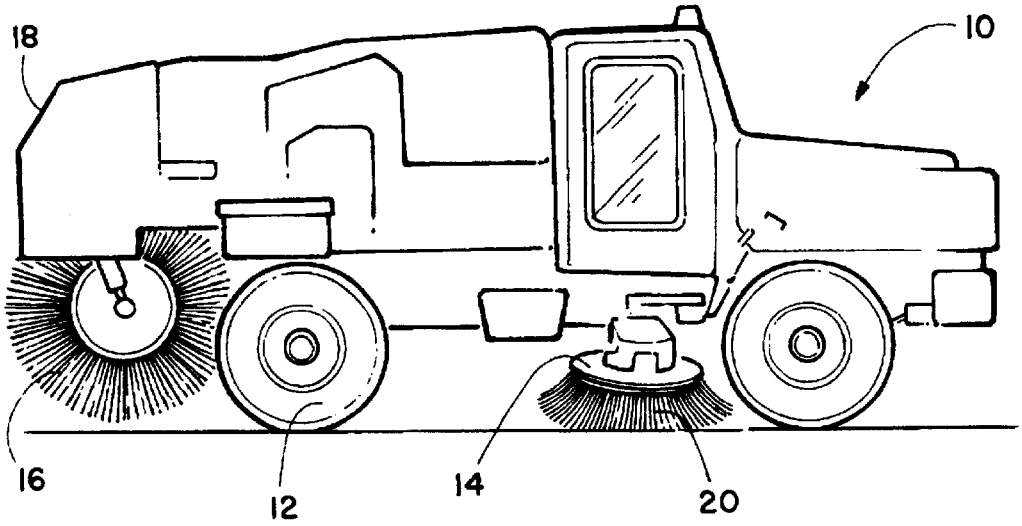
FIG. 1 is a schematic side elevation view of a portion of a street sweeping machine showing the brush assembly of this invention in place for sweeping.

Referring to FIG. 1 there is seen a simplified side elevation view, representative of a conventional street sweeper 10. Sweeper 10 is mounted on a plurality of wheels 12 for powered movement along a street, factory floor or other similar surface. Two brush assemblies 14 are mounted adjacent to front wheel for powered rotation in a generally horizontal plane. Brush assemblies 14 extend beyond the side of the vehicle a selected distance to clan up against curbs or other adjacent objects. Brush assemblies 14 generally rotate so that the forward edges are moving toward the centerline of sweeper 10, so that dirt and debris encountered by the vehicle is moved toward the vehicle centerline. As sweeper 10 moves, a large brush 16 toward the back of the sweeper rotates about a horizontal axis transverse to the sweeper centerline to sweep accumulated dirt and debris forwardly and upwardly into a large container 18.

Bristles 20 on brush assemblies 14 are in contact with the surface being swept, which is likely to be hard and irregular, such as concrete, so that the bristles may rapidly wear down. Also, the periphery of the brush assembly may bump against curbs or other objects. In order to replace worn bristles, it is important that the brush assembly be easily disassembled for bristle replacement and then easily reassembled. Further, the brush assembly 14 must be sturdy and maintain the brush in proper alignment during use.

Figure 2:
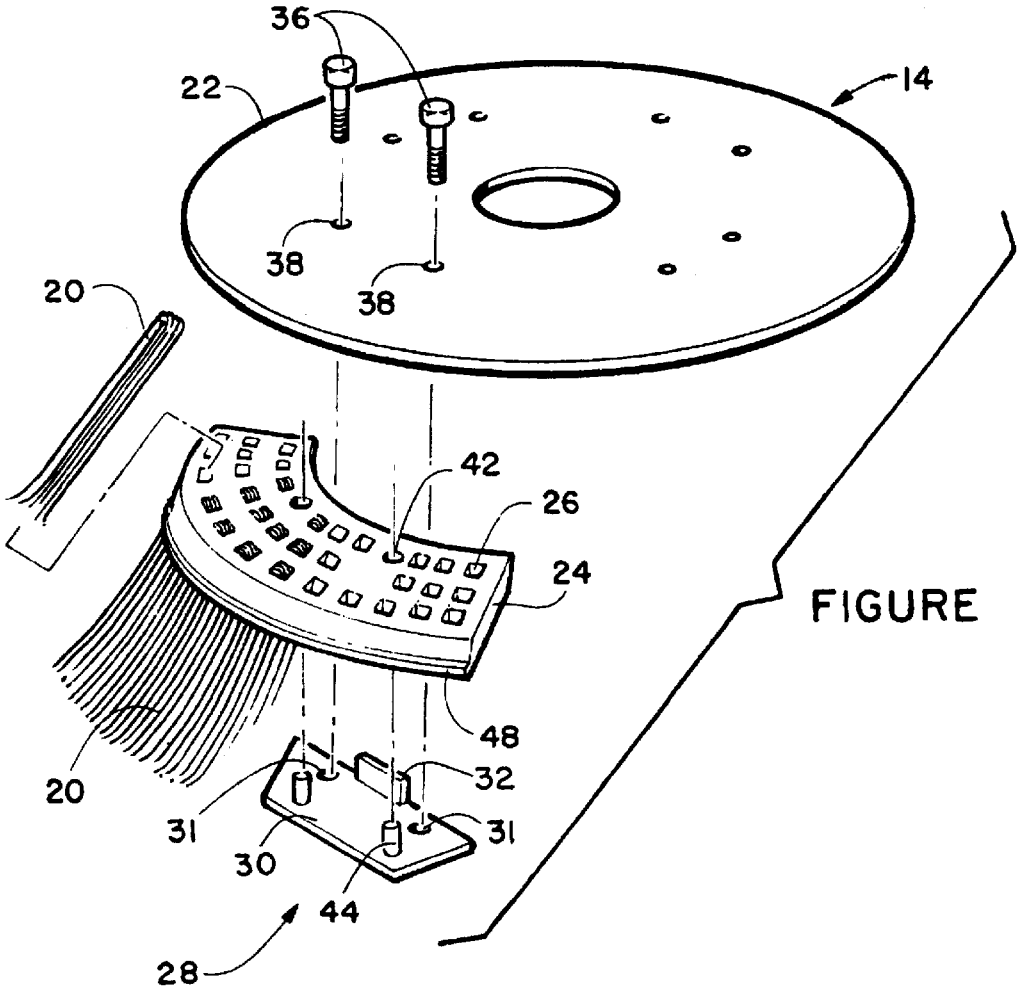
FIG. 2 is and exploded view of the brush assembly.

Brush assembly 14 is shown in exploded perspective in FIG. 2, which shows a portion of the generally circular disk 22 with one of a peripheral plurality of brush holders 24. Bristle mounting holes 26 extend through the brush holders 24 in a predetermined pattern, as detailed in FIGS. 3–6, discussed below.

A clamp assembly 28 is provided to hold brush holders 24 firmly against disk 22 during operation of sweeper 10. Assembly 28 comprises a clamp bar 30 for engaging the side of a brush holder opposite that engaging disk 22 while extending toward the center of disk 22. An offset support 32, typically a small plate welted to clamp bar 30, has a thickness the same as the thickness of brush holder 24. A threaded member extends through clamp bar 30 between brush holder 24 and offset support 32 to press the clamp bar against the brush holder. In one embodiment of mounting a threaded member such as a bolts 36 extend through holes 38 in disk 22 to cooperatively engages a conventional nut affixed to the hidden side of clamp bar 30 in line with the holes or apertures 31. Alternatively, other threaded members could be used, such as a stud (not shown) welded to disk 22 could extend though a hole in clamp bar 30 to a loose nut on the upper surface of the clamp bar 30.

Alignment holes 42, preferably two although more could be used if desired, are provided in brush holder 24, positioned to receive alignment pins 44 on the side of clamp bar 30 that engages brush holder 24. The cooperating alignment pins 44 and alignment holes 42 will keep brush holder 24 precisely in the optimum position during use and will hold these parts in alignment during disassembly and reassembly of the brush assembly whenever bristles 20 need to be replaced.

Figure 3:
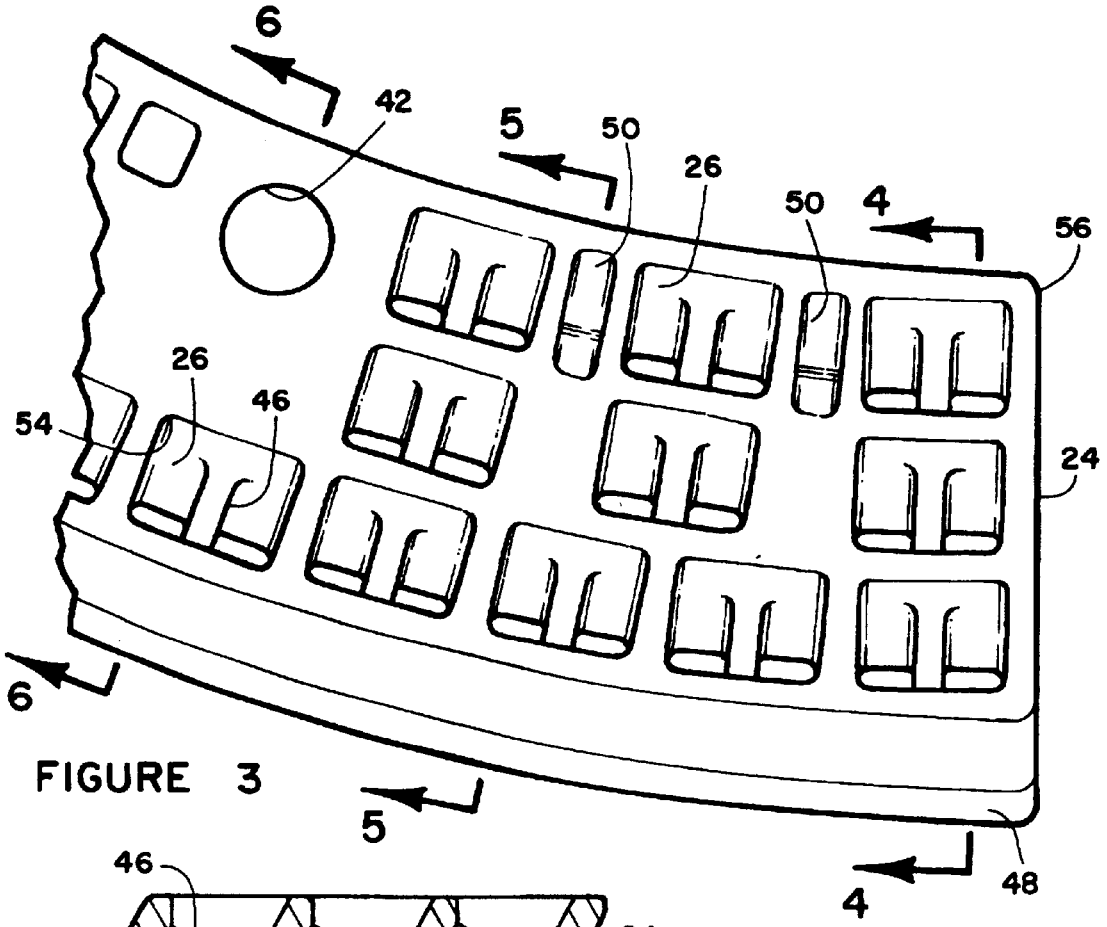
FIG. 3 is a plan view of the brush holder taken from the disk engaging side.

Details of brush holders 24 are provided in FIGS. 3–6. In FIG. 3, brush holder 24 is seen in plan view from the side that engages disk 22.

Brush holders 24 are preferably formed from a high strength material, such as fiber reenforced nylon, by injection molding. Preferably, three approximately parallel peripheral rows of bristle receiving holes 26 are provided. To accommodate curvature of each brush holder 24 has fewer holes 26 in the inner rows.

Figure 4:
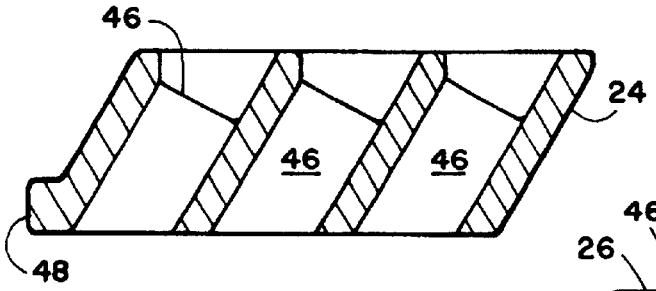
FIG. 4 is a section view taken on line 4—4 in FIG. 3.

Each bristle receiving hole 26 has a central, transverse, wall 46. Each bristle, typically formed from piano wire or the like, has a narrow "U-shaped" configuration, with the distance between the legs of the "U" being greater than the width of wall 46 and less than the width of hole 26. Since disk 22 covers the upper surface (seen in FIG. 3) of brush holder 24, bristles 20 are held in place with some ability to move and flex slightly in use. A few bristles 20 are shown in FIGS. 3 and 4 to illustrate bristle position without cluttering the drawing.

An radially extending, circular ridge 48 is provided as a "bumper" to protect brush holder 24 against damage or sever wear from contact of the brush holder with a curb or other object during sweeping. Often, the outer edge of disk 22 will contact the curb. Since disk 22 is generally made from steel or the like, wear will be slow. Since bumper ridge 48 is spaced from disk 22 the thickness of brush holder 24, the ridge will protect the brush holder from excessive wear in cases where a curb or object is high enough to impact the ridge but not high enough to impact the edge of disk 22.

Figure 5:
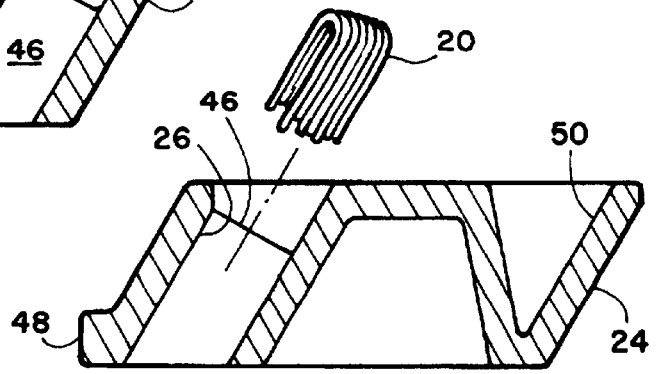
FIG. 5 is a section view taken on line 5—5 in FIG. 3.
Figure 6:
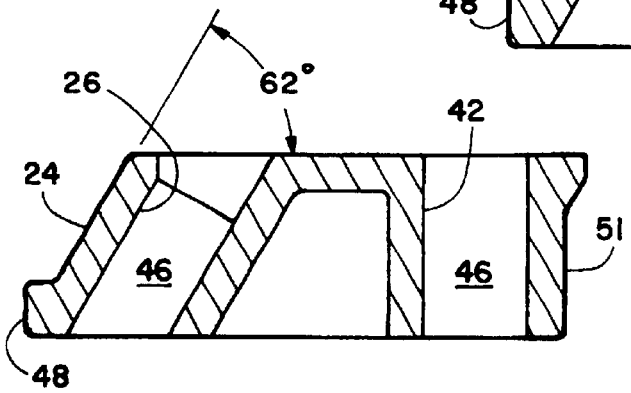
FIG. 6 is a section view taken on line 6—6 in FIG. 3.

As seen in FIG. 5, spaces between adjacent peripheral holes 26 caused by the necessity to have fewer holes in inner rows due to curvature, either that space can be solid or can have a recess 50. For maximum strength, a wall 51 may be formed all the way around alignment hole 42, as seen in FIG. 6.

In order to prevent stress concentrations and subsequent cracking in use, the approximately rectangular cross section bristle holes 26 preferably have rounded corners 54, optimally with a radius of from about 0.025 to 0.05 inch. Similarly, the ends of brush holder preferably have corners 56 with radii of from about 0.12 to 0.14 inch.

Figure 7:
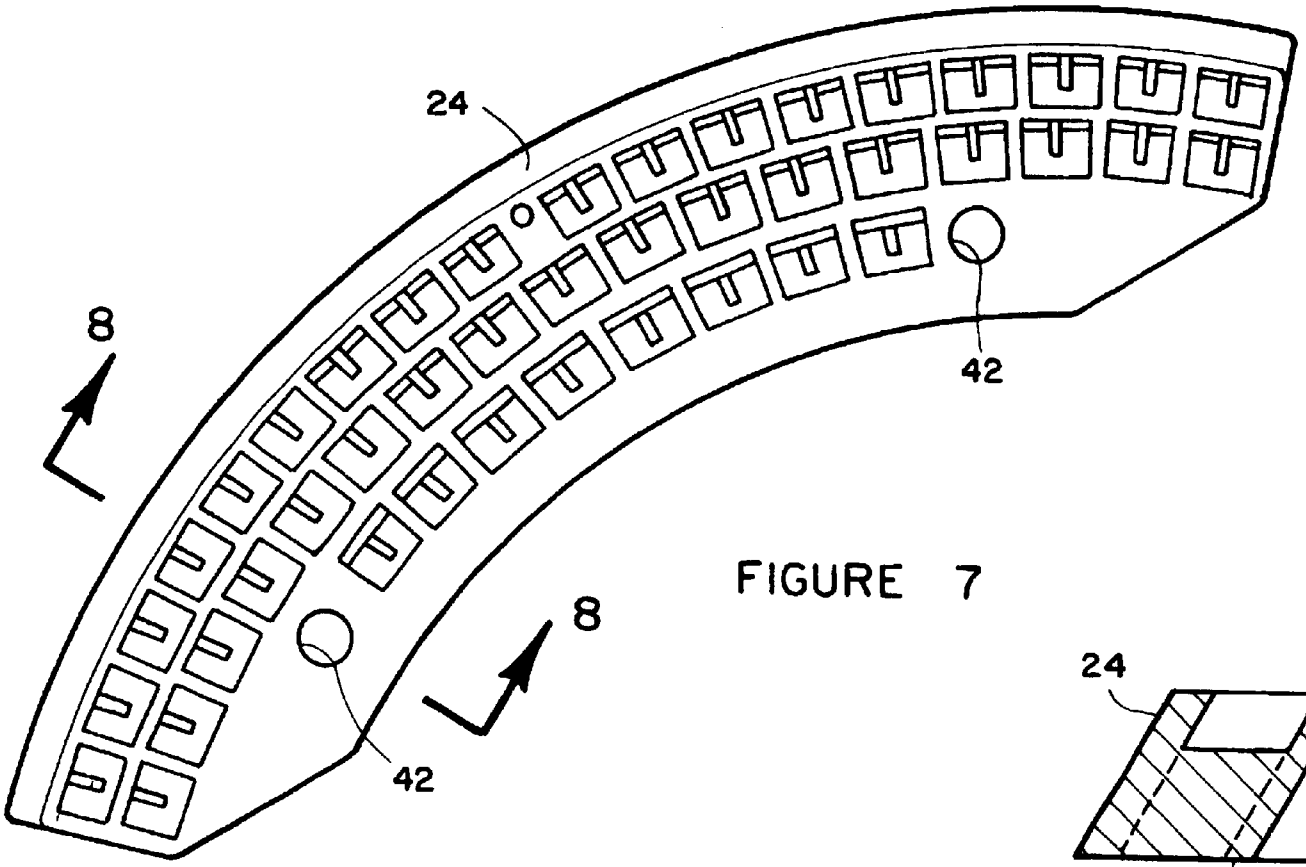
FIG. 7 is an additional embodiment of the device which includes a cooperating nut affixed to the lower side of the brush holder and upper side of clamp bar.
Figure 8:
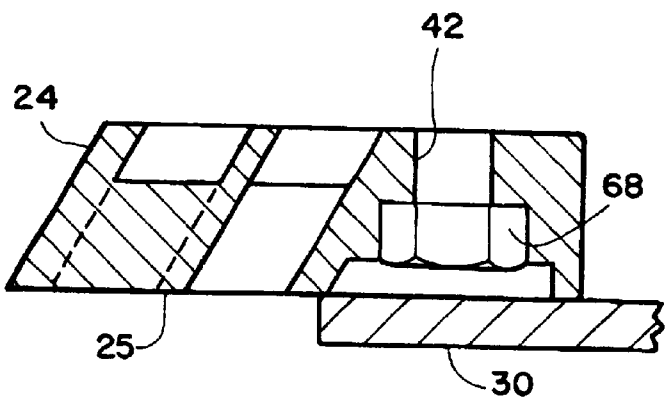
FIG. 8 is a section view taken on line 8—8 in FIG. 7.

Additional embodiments to prevent stress concentration and cracking in use and to provide additional mounting configurations are depicted in FIG. 7 through FIG. 13. FIG. 7 shows an embodiment of the device with a mounting nut 68 cooperatively engaged in the bottom surface 25 of the brush holder 24 which could be done by forming an aperture to match the shape of the nut 68 and allow for a compression fit of the nut 68 therein.

The mounting nut 68 is engaged with the surface of the clamp bar 30 and holds it into position against the bottom surface 25 of the brush holder 24 before, and during mounting.

Figures 9, 10:
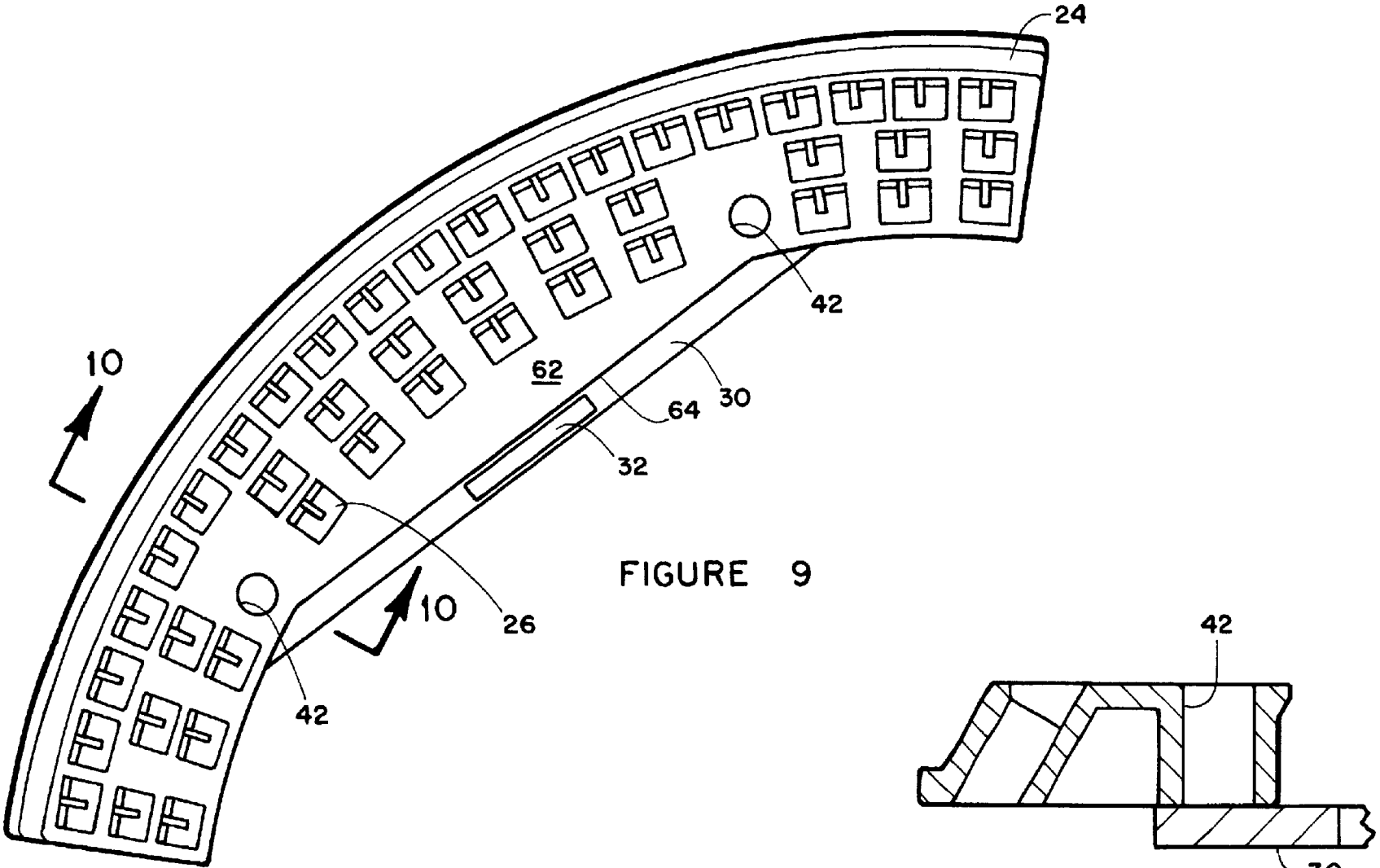
FIG. 9 is an additional embodiment of the device having an extra reinforcement section for strength.
FIG. 10 is a section view taken on line 10—10 of FIG. 9.

FIG. 9 depicts the brush holder 24 has an additional reinforcing strip area 62 extending from and defined by the area of the brush holder 24 between the alignment holes 42 and rearward of the inward most row of peripheral holes 26 and the inner edge 64 of the brush holder 24 to provide added strength to the brush holder 24 during use. As shown in FIG. 9 the clamp bar 30 extends beyond the inner edge 64 and toward the center of the disk 22. This additional reinforcing strip area 62 in the current best mode terminates at a substantially straight inner edge 64 that when adjacent to and contacting the side of the similarly shaped offset support 32 extending from the clamp bar 30 provides additional lateral and vertical stability to the mount when mounted to the operating spinning disk 22. Of course the inner edge 64 and side of the offset support 32 might be curved or shaped differently and maintain the support but the current best mode features substantially straight edges on both.

Figure 11:
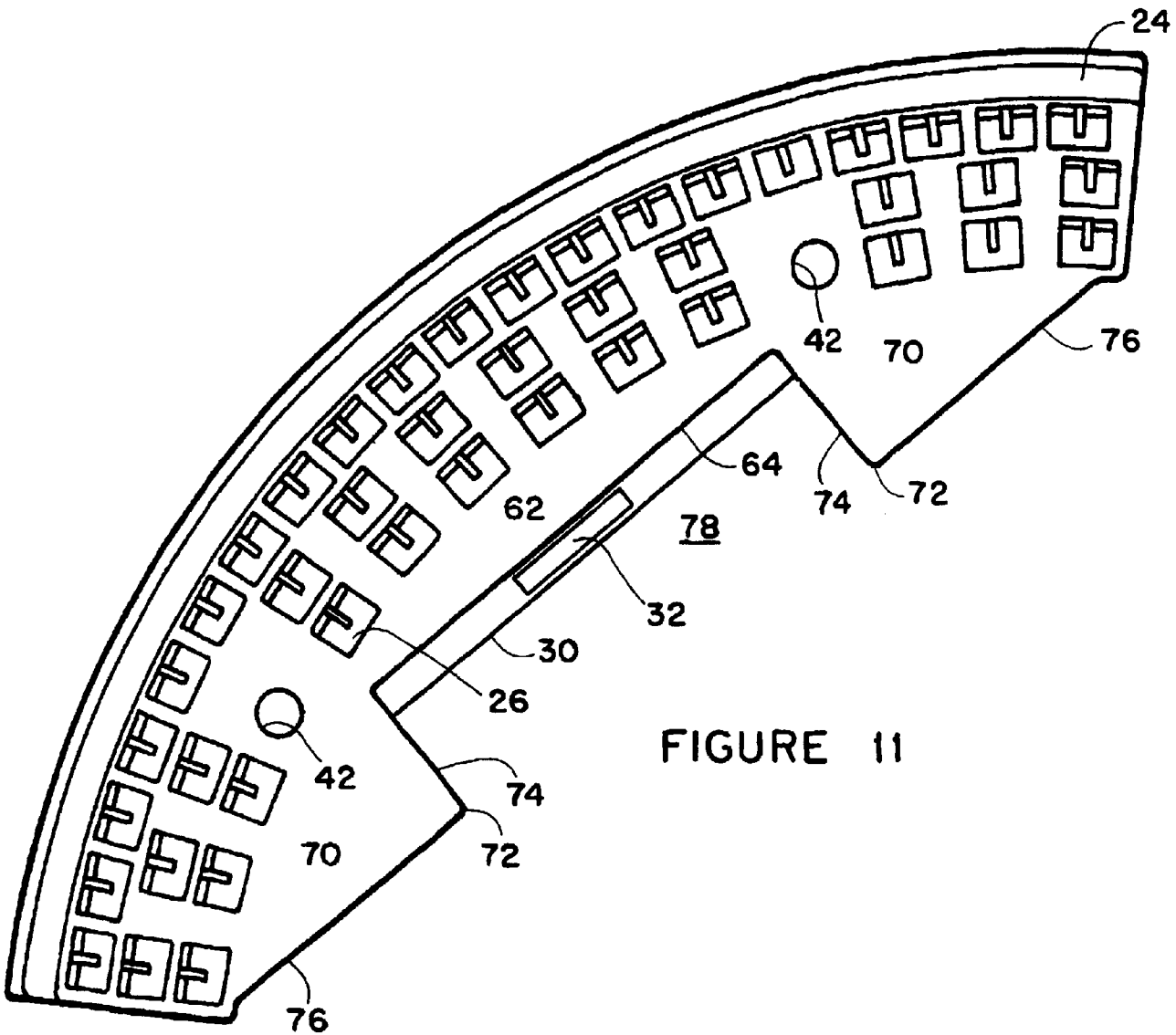
FIG. 11 depicts another embodiment of the device which includes a reinforcing section and a pair of reinforcing tabs for strength.

FIG. 11 depicts the disclosed device as shown in FIG. 9 with the addition of a pair of reinforcing tabs 70 having corners 72 formed by intersection of substantially perpendicular extensions 74 of the inner edge 64 and substantially straight inwardly extending sides 76. The result being a notch area 78 to accommodate parts of the clamp assembly 28 and a much stronger brush holder 24 with the addition of the reinforcing strip area 62 and the two reinforcing tabs 70 which as shown have a substantially triangular shape with an arched hypotenuse which has shown to yield a substantial increase in strength to the device when in use. The construction of the wall of the brush holder 24 in the reinforcing strip area 62 and the reinforcing tabs 70 could be solid or in a honeycombed fashion with ribs to provide strength but reduce weight, much like that shown in FIG. 4 with the intent being a construction to provide a strong wall surface to both strengthen the brush holder 24 from cracking during operation.

Figure 12:
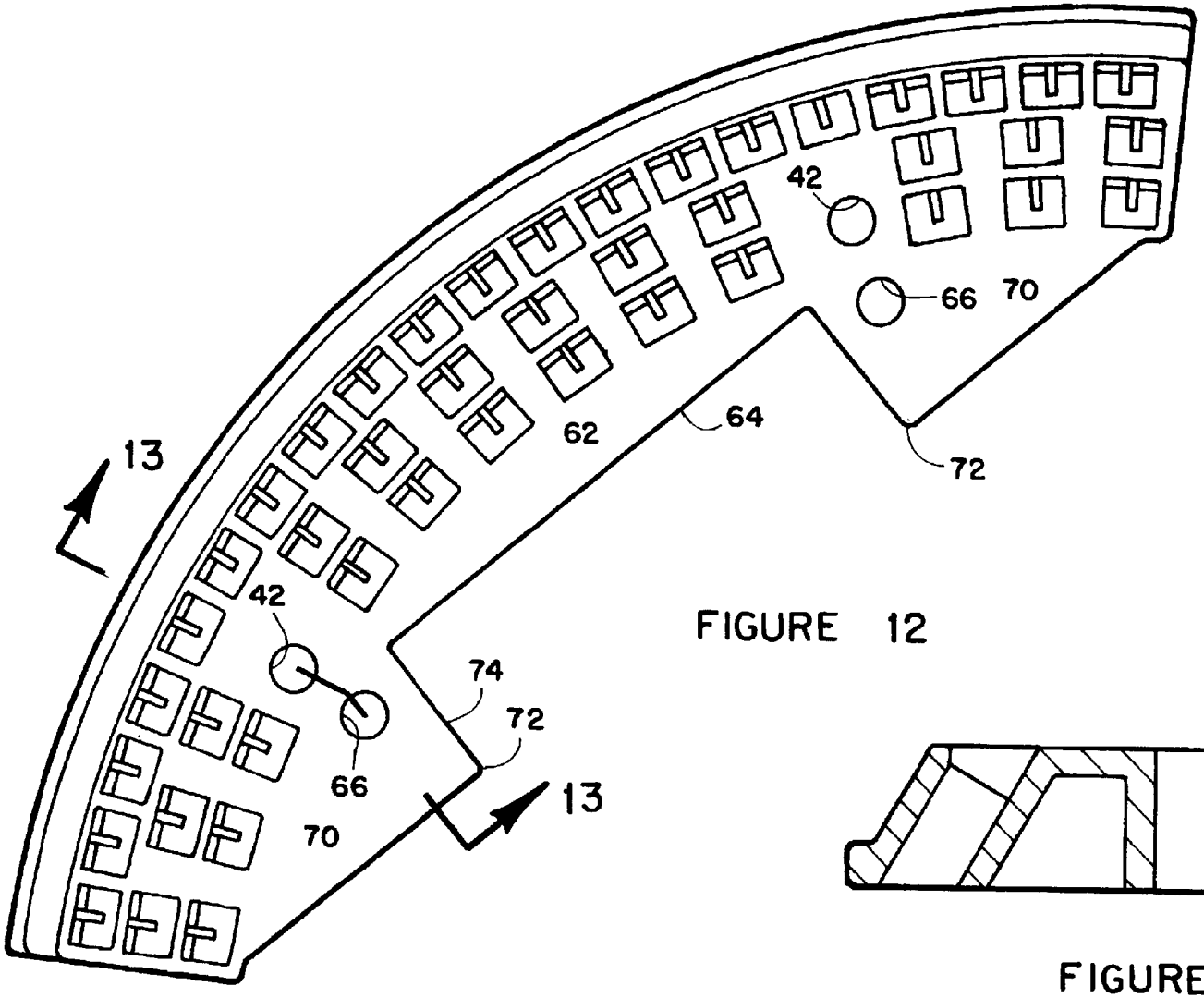
FIG. 12 depicts an embodiment of the device which includes reinforced sections as well as additional mounting apertures for a plurality of mounting options.
Figure 13:
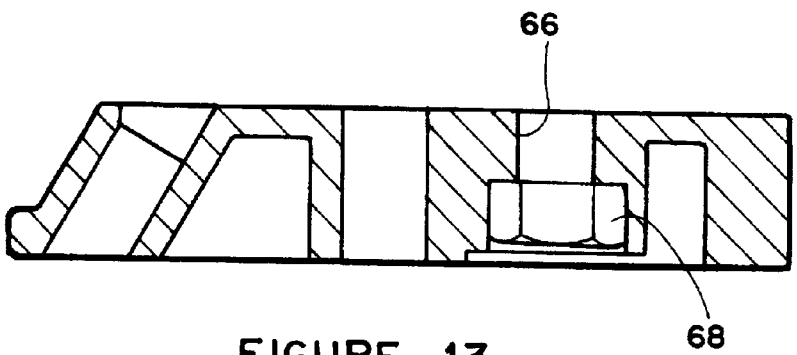
FIG. 13 is a section view taken on line 13—13 of FIG. 12.

FIG. 12 depicts another favored embodiment of the disclosed device as shown in FIG. 11 which provides an additional pair of mounting apertures 66 communicating through the brush holder 24 at positions determined to be inline with another pair of bolts 36 which would mount through the disk 22 and through the mounting apertures 66 wherein the bolts 36 would cooperatively engage mounting nuts 68 which are affixed to the brush holder 24 on the bottom side of the brush holder opposite the side contacting the disk 22. This would allow the brush holder 24 to be mounted to the disk 22 using bolts 36 which would be cooperatively engaged with the mounting nuts 68 in addition to the aforementioned mounting configuration using the clamping assembly 28. The provision of this pair of mounting apertures 66 will allow the improved brush holder 24 to be mounted on disks 22 that may not have been configured yet to accept the clamp assembly 28 and still be used at a later date when accommodations and mounting for the clamping assembly 28 have been provided on the disk 22. The user thus still has the benefit of the added reinforcing strip 62 area between the inner edge 64 and the inward most row of peripphial holes 26, the reinforcing tabs 70, and the other improvements of the disclosed device using a mount to the disk 22. The user can also later take advantage of the preferred mount using the clamp assembly 28 when the holes 38 in the disk 22 are in place to accommodate the bolts 36 for the clamp assembly 28. In this fashion, the user takes advantage of the additional utility with the strengthened by the wall surfaces provided by the reinforcing strip area 62 and reinforcing tabs 70 and the other enhancements of the device when mounted to a non conforming disk 22, and also allows the user to upgrade the clamp assembly later to achieve the best mount at a later time.

Still further, if the nuts 68 are attached on their lower side, to the surface of the clamp bar 30 which abuts the lower surface 25 of the brush holder 24, they provided a mount to hold the clamp bar 30 against the lower surface 25 of the brush holder 24 during mounting to a properly configured disk 22.

While certain specific relationships, materials and other parameters have been detailed in the above description of preferred embodiments, those can be varied, where suitable, with similar results. Other applications, variation and ramifications of the present invention will occur to those skilled in the art upon reading the present disclosure. Those are intended to be included within the scope of this invention as defined in the appended claims.

I claim:

1. An improved brush assembly for use with sweeping machines, which comprises:

a generally circular disk, having a periphery and a center, for mounting for rotation on a sweeping machine adjacent to a surface to be swept;

a plurality of brush holders for mounting on a first side of said circular disk adjacent to said periphery of said circular disk;

a plurality of alignment holes in each said brush holder;

clamp means for releasably clamping each of said brush holders against said circular disk;

said clamp means comprising a clamp bar for engaging each brush holder on a respective surface opposite said circular disk;

said clamp bar extending toward said center beyond said brush holder; and means for pressing said clamp bar toward said brush holder comprising at least one threaded means extending through said circular disk and said brush holder, a nut, said nut releasably attached to a bottom surface of said brush holder and attached said clamp bar; said nut cooperatively engageable with said threaded means to provide pressure contact between said clamp bar and said brush holder;

offset support means secured to said clamp bar between said pressing means and said center;

a plurality of pins on each clamp bar for entering said alignment holes when each said clamp bar is clamped against each said brush holder; and a plurality of bristle mounting holes through each said brush holder, each said bristle mounting hole having a transverse retainer wall for retaining a U-shaped bristle extending through said bristle mounting hole with a leg of said U-shape extending on opposite sides of said retainer wall with said bristles extending at a predetermined angle to said circular disk.

2. An improved brush assembly for use with sweeping machines having generally circular disk having a periphery and a center, mounted for rotation on a sweeping machine adjacent to a surface to be swept, comprising:

a brush holder for mounting on a first side of said circular disk adjacent to said periphery of said circular disk, said brush holder having an inner edge and outer edge;

a plurality of alignment holes in said brush holder;

clamp means comprising a clamp bar engaging a surface of said brush holder opposite said circular disk and extending toward said center beyond said brush holder, and threaded means for releasably clamping said brush holder against said circular disk;

an offset support means attached to said clamp bar between said threaded means and said center, said offset support means having a side surface;

a plurality of bristle mounting holes through said brush holder, each said bristle mounting hole having a transverse retainer wall for retaining a U-shaped bristle extending through said bristle mounting hole with a leg of said U-shape extending on opposite sides of said retainer wall, said bristle mounting holes being configured so that bristles mounted therein extend outwardly of said center at a defined angle to said circular disk;

a reinforcing strip area of said brush holder defined by the area of said brush holder between the alignment holes, the bristle mounting holes closest to said center, and said inner edge of said brush holder; and said inner edge of said brush holder shaped substantially the same as said side surface of said offset support means, whereby said side surface may support to said inner edge of said brush holder.

3. The improved brush assembly according to claim 2, additionally comprising a pair of reinforcing tabs, said reinforcing tabs defined by the area between the bristle mounting holes closest to the center on one side, and a corner formed by edge extensions from said inner edge of said brush holder and substantially straight inwardly extending sides from said outer edge of said brush holder.

4. The improved brush assembly according to claim 3 additionally comprising a pair of mounting apertures communicating through the brush holder at determined positions, said determined positions, to be inline with a pair of disk mounting apertures communicating through said disk when said brush holder is operatively mounted to said disk, thereby providing an in line channel through said disk and said brush holder to accommodate a bolt therethrough, said bolt cooperatively engageable with a nut on one end, whereby a mount to said disk of said brush holder may be provided by said bolt cooperatively engaged with said nut.

5. An improved brush assembly for use with sweeping machines having generally circular disk having a periphery and a center, mounted for rotation on a sweeping machine adjacent to a surface to be swept, comprising:

a brush holder for mounting on a first side of said circular disk adjacent to said periphery of said circular disk, said brush holder having an inner edge and outer edge;

a plurality of bristle mounting holes through each said brush holder, each said bristle mounting hole having a transverse retainer wall for retaining a U-shaped bristle extending through said bristle mounting hole with a leg of said U-shape extending on opposite sides of said retainer wall, said bristle mounting holes being configured so that bristles mounted therein extend outwardly of said center at a defined angle to said circular disk;

a reinforcing strip area of said brush holder defined by the area of said brush holder between the bristle mounting holes closest to said center, and said inner edge of said brush holder;

a pair of reinforcing tabs, said reinforcing tabs defined by the area between the bristle mounting holders closest to the center on one side, and a corner formed by intersection of edge extensions from said inner edge of said brush holder and substantially straight inwardly extending sides from said outer edge of said brush holder, and a pair of mounting apertures communicating through the brush holder at determined positions, said determined positions, to be inline with a pair of disk mounting apertures communicating through said disk when said brush holder is operatively mounted to said disk, thereby providing an in line channel through said disk and said brush holder to accommodate a bolt therethrough, said bolt cooperatively engageable with a nut on one end, whereby a mount to said disk of said brush holder may be provided by said bolt cooperatively engaged with said nut.

* * * * *